US006955281B1

(12) United States Patent
Wei

(10) Patent No.: US 6,955,281 B1
(45) Date of Patent: Oct. 18, 2005

(54) ELECTRIC NAILING GUN THAT AUTOMATICALLY REDUCES IMPACT OF PLUNGER WHILE NO NAIL IS INSIDE

(75) Inventor: Chen-Ku Wei, Nantou (TW)

(73) Assignee: Mobiletron Electronics Co., Ltd., Taichung Hsien (TW)

( * ) Notice: Subject to any disclaimer, the term of this patent is extended or adjusted under 35 U.S.C. 154(b) by 50 days.

(21) Appl. No.: 10/896,924

(22) Filed: Jul. 23, 2004

(51) Int. Cl.[7] ..... B25C 1/14
(52) U.S. Cl. ..... 227/2; 227/8; 227/120; 227/131; 227/156
(58) Field of Search ..... 227/2, 8, 10, 109, 227/120, 131, 156

(56) References Cited

U.S. PATENT DOCUMENTS 3,837,556 A * 9/1974 Doyle ..... 227/136
5,437,404 A * 8/1995 Shkolnikov ..... 227/109
5,592,580 A * 1/1997 Doherty et al. ..... 388/815
5,772,096 A * 6/1998 Osuka et al. ..... 227/5
5,911,350 A * 6/1999 Bolger et al. ..... 227/2
6,382,492 B1 * 5/2002 Moorman et al. ..... 227/8
6,431,425 B1 * 8/2002 Moorman et al. ..... 227/8
6,604,666 B1 * 8/2003 Pedicini et al. ..... 227/131
6,739,490 B1 * 5/2004 Shkolnikov et al. ..... 227/2

* cited by examiner

*Primary Examiner*—Scott A. Smith
(74) *Attorney, Agent, or Firm*—Bacon & Thomas PLLC

(57) ABSTRACT

An electric nailing gun is disclosed to use a sensor in the nail magazine and to connect the sensor to a control circuit such that when a magazine follower is moved to a predetermined position in the nail path, the sensor sends a control signal to the control circuit to drive a counter to start counting the number of striking actions of the plunger, and the control circuit controls the electric nailing gun to reduce the plunger impact when the counting of the counter reaches a predetermined value.

6 Claims, 1 Drawing Sheet

ELECTRIC NAILING GUN THAT AUTOMATICALLY REDUCES IMPACT OF PLUNGER WHILE NO NAIL IS INSIDE

BACKGROUND OF THE INVENTION

1. Field of the Invention

The present invention relates to an electric nailing gun, and more particularly, to an electric nailing gun that automatically reduces the impact of a plunger while no nail is inside.

2. Description of the Related Art

When using a conventional electric nailing gun and no nail is inside the nail magazine, actuating the electrically-controlled switch still causes the plunger to move continuously. Striking the plunger when the nail magazine is empty causes the plunger to impact the structure of the gun body around the bore. Therefore, the plunger and the structure of the gun body around the bore wear quickly as the electric nailing gun is operated for a period of time. Some of conventional electric nailing guns are installed with elastic cushion means, such as a rubber cushion, around the bore of the gun body for buffering the impact of the plunger when the plunger runs idle. Due to high striking frequency and high impact force of the plunger, the service life of such rubber cushion is very short. In addition, the rubber cushion will become degenerate, like hardened, within a short time to be of no buffer. Therefore, in some countries, like USA, there is a related safety code requiring that an electric nailing gun has to pass the impact test of a long period and many times while no nail is inside the gun. This impact test is a great challenge to electric nailing gun manufacturers who are trying to develop electric nailing guns having more powerful impact.

In view of the aforesaid problem, an electric nailing gun with a nail sensor is developed. The nail sensor is mounted at the top of the nail magazine to detect whether the presence of the magazine follower is in a predetermined position. The magazine follower reaches such a predetermined position when the nail magazine is empty. At the same time, the nail sensor stops the electric nailing gun from working. However, because the nails are not mechanically precise to have relatively greater tolerance allowed while being manufactured, and the nails and the nail magazine also have their manufacturing tolerance, the sensor may misjudge to stop the electric nailing gun from working when the nails are still left in the nail magazine or to have the electric nailing gun keep working when the nail magazine is empty.

Therefore, it is desirable to provide an electric nailing gun that eliminates the aforesaid drawbacks.

SUMMARY OF THE INVENTION

The present invention has been accomplished under the circumstances in view. It is the primary objective of the present invention to provide an electric nailing gun, which automatically reduces the impact of the plunger to avoid its damage when the gun is empty.

To achieve the objective of the present invention, the electric nailing gun is comprised of a gun body, a plunger, a spring member, a coil, a nail magazine, a control circuit, and a sensor. The gun body defines a plunger reciprocating path having a first end and a second end and has a bore at the second end of the plunger reciprocating path. The plunger is mounted inside the gun body for a reciprocating motion along the plunger reciprocating path. The spring member is connected between the plunger and the gun body for holding the plunger at the first end of the plunger reciprocating path. The coil is mounted inside the gun body for generating a magnetic field attracting the plunger to move along the reciprocating path from the first end to the second end to further drive a nail out of the gun body while electrically connected. The nail magazine includes a magazine shell provided for receiving a plurality of nails and defining a nail path in communication with the plunger reciprocating path, a magazine follower movable in the nail path for moving the nails out of the nail path into the plunger reciprocating path for striking by the plunger, and a magazine spring connected between the magazine shell and the magazine follower for pushing the magazine follower to force the nails out of the nail path into the plunger reciprocating path. The control circuit for controlling supply of electric current to the coil includes a counter for counting the number of striking action of the plunger. The sensor is mounted in the nail magazine and is electrically connected to the control circuit for outputting a control signal to the control circuit to further drive the counter to start counting the number of striking actions of the plunger when the magazine follower is moved to a predetermined position in the nail path, thereby enabling the control circuit to reduce the supply of electric current to the coil when the counting of the counter reaches a predetermined value.

DETAILED DESCRIPTION OF THE INVENTION

Figure 1:
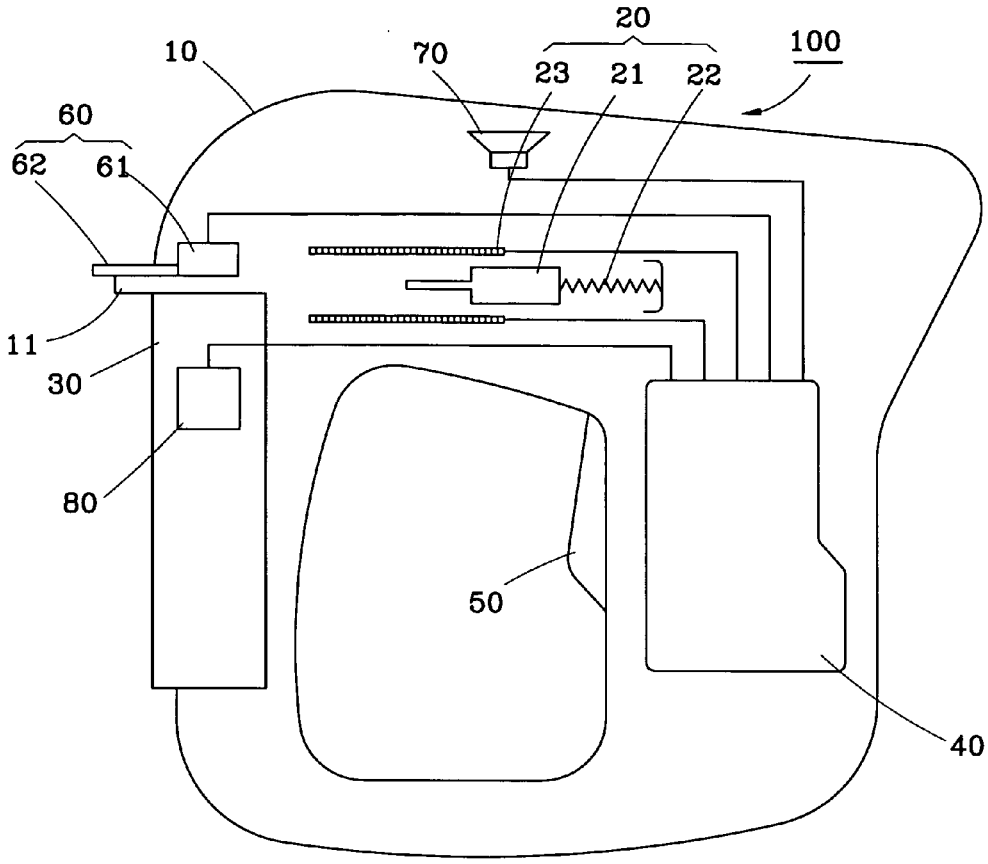
FIG. 1 is a schematic view showing the structure of an electric nailing gun constructed according to the present invention.
Figure 2:
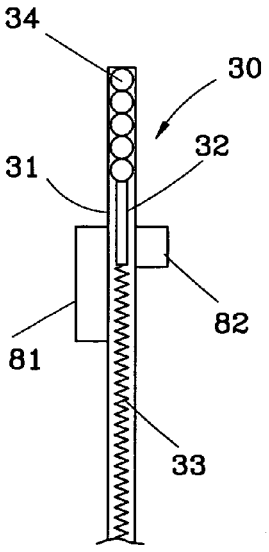
FIG. 2 is a schematic view showing the structure of a nail magazine for use in an electric nailing gun according to the present invention.

Referring to FIGS. 1 and 2, an electric nailing gun 100 in accordance with the present invention is shown comprised of a gun body 10, a striking unit 20, a nail magazine 30, a control circuit 40, an electrically-controlled switch 50, a safety mechanism 60, a warning device 70, and a sensor 80.

The striking unit 20 includes a plunger 21, a spring member 22, and a coil 23. The plunger 21 is mounted inside the gun body 10 for a reciprocating motion along a predetermined path. The spring member 22 is connected between the plunger 21 and the gun body 10 for holding the plunger 21 at an end of the aforesaid path. The coil 23 is mounted inside the gun body 10 for generating a magnetic field attracting the plunger 21 while electrically connected. Upon formation of such magnetic field, the plunger 21 is attracted to move to the other end of the aforesaid path, thereby achieving a nail striking action.

The nail magazine 30 includes a magazine shell 31, a magazine follower 32, and a magazine spring 33. The magazine shell 31 for accommodating a plurality of nails 34, which are movable along a predetermined path intersecting the reciprocating path of the plunger 21. When one nail 34 reaches the reciprocating path of the plunger 21, the plunger 21 is controlled to drive the nail 34 out of the gun body 10. The magazine follower 32 is mounted in the magazine shell 31 and movable along the moving path of nails 34. The magazine spring 33 is connected between the magazine shell 31 and the magazine follower 32 for driving the magazine follower 32 and then the nails 34 towards the reciprocating path of the plunger 21.

The control circuit 40 controls supply of electric current to the coil 23, including a counter (not shown), which can be a programmable IC for counting the number of striking actions of the plunger 21.

The electrically-controlled switch 50 is connected to the control circuit 40 and is served as a trigger of the electric nailing gun 100 to control the striking action.

The safety mechanism 60 includes a safety switch 61 and a push rod 62. The safety switch 61 is connected to the control circuit 40 for turning on/off the power of the electric nailing gun 100. The push rod 62 has an end protruding out of a bore 11 of the electric nailing gun 100 and the other end connected to the safety switch 61 for controlling the safety switch 61. When the bore 11 of the electric nailing gun 100 contacts against a surface of a workpiece, the push rod 62 is moved backwards to activate the safety switch 61 to enable the electric nailing gun 100 to start working.

The warning device 70 is connected to the control circuit 40 and can be controlled by the control circuit 40 to generate a warning signal.

Figure 3:
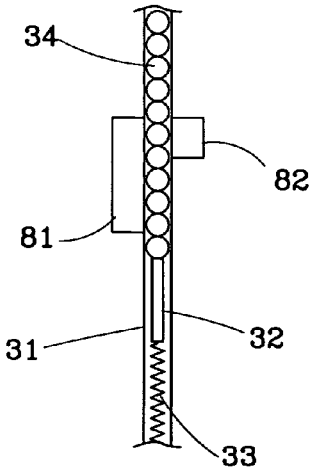
FIG. 3 is similar to FIG. 2, showing that nails are blocked in a nail path between a transmitting side and a receiving side according to the present invention.
Figure 4:
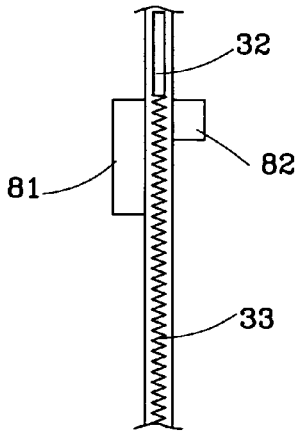
FIG. 4 is similar to FIG. 2, showing that the nails and a magazine follower are moved out of the nail path between the transmitting side and the receiving side according to the present invention.

The sensor 80 is mounted on the nail magazine 30 and is electrically connected to the control circuit 40 by lead wires. When the magazine follower 32 reaches a predetermined position in the nail magazine 30, the sensor 80 sends a control signal H to the control circuit 40 to drive the control circuit 40 to run a corresponding control procedure. The sensor 80 can be a contact type electrically-controlled switch directly to be touched by the magazine follower 32 to output the aforesaid control signal H. Alternatively, the sensor 80 can be a non-contact type sensor. According to the present preferred embodiment, the sensor 80 includes a transmitting side 81 and a receiving side 82 respectively disposed at two sides of the nail magazine 30. The transmitting side 81 can be controlled to transmit a detection signal S receivable by the receiving side 82. The path of the detection signal S intersects the moving path of the magazine follower 32. After the nails 34 are moved to pass by the path between the transmitting side 81 and the receiving side 82 by the magazine follower 32, the nails 34 or the magazine follower 32 does not block the detection signal S, allowing the receiving side 82 to receive the detection signal S, and therefore, the sensor 80 sends the control signal H to the control circuit 40 at the same time (see FIGS. 3 and 4).

The operation of the present invention is described hereinafter. When the control circuit 40 receives none of the control signal H from the sensor 80, the electric nailing gun 100 keeps working, and the control circuit 40 outputs a constant current to the coil 23 when the user activates the electrically-controlled switch 50 at the same time. Therefore, the impact of the plunger 21 remains unchanged for normal nailing operation.

Upon reception of the control signal H by the control circuit 40, the counter (not shown) of the control circuit 40 starts counting the striking action of the plunger 21. When the number of striking actions of the plunger 21 reaches a predetermined value, the counter (not shown) of the control circuit 40 stops counting, and then the control circuit 40 reduces the input amount of electric current to the coil 23, thereby reducing the intensity of the magnetic field and the impact of the plunger 21. At the same time, the control circuit 40 drives the warning device 70 to generate a warning signal, achieving the desired results of protection and warning for the present invention.

Because the nails 34 may be still left in the nail magazine 30 after transmission of the control signal H to the control circuit 40 due to poor precision of the nails 34, the counter (not shown) will not stop counting the number of the striking actions of the plunger 21 unless the predetermined value is reached. When the predetermined value is reached, the impact of the plunger 21 is reduced. If the control circuit 40 is interrupted from receiving the control signal H during the counting, and meanwhile, the impact of the plunger 21 is not reduced, the counter will immediately stop counting and zero the reading. If the control signal receiving status is interrupted after the impact of the plunger is reduced, the counter will be zeroed, and the electric nailing gun 100 will be reset. Therefore, this design automatically reduces the impact of the plunger 21 to avoid damaging the electric nailing gun 100 when the nail magazine 30 is empty, and avoid reducing the impact of the plunger upon presence of the nails 34 in the electric nailing gun 100.

What is claimed is:

1. An electric nailing gun comprising:

a gun body defining therein a plunger reciprocating path, said plunger reciprocating path having a first end and a second end, said gun body having a bore at the second end of said plunger reciprocating path;

a plunger mounted inside said gun body for a reciprocating motion along said plunger reciprocating path;

a spring member connected between said plunger and said gun body for holding said plunger at the first end of said plunger reciprocating path;

a coil mounted inside said gun body for generating a magnetic field attracting said plunger to move along said reciprocating path from the first end to the second end;

a nail magazine having a magazine shell for accommodating a plurality of nails, said magazine shell defining a nail path in communication with said plunger reciprocating path, a magazine follower movable along said nail path for moving said nails out of said nail path into said plunger reciprocating path for striking by said plunger, and a magazine spring connected between said magazine shell and said magazine follower for pushing said magazine follower to force nails out of said nail path into said plunger reciprocating path;

a control circuit for controlling supply of electric current to said coil, said control circuit having a counter for counting the number of striking actions of said plunger; and a sensor mounted in said nail magazine and electrically connected to said control circuit for outputting a control signal to said control circuit to further drive said counter to start counting the number of striking actions of said plunger when said magazine follower is moved to a predetermined position in said nail path, whereby said control circuit reduces the supply of electric current to said coil when the counting of said counter reaches a predetermined value.

2. The electric nailing gun as defined in claim 1, wherein said sensor comprises a transmitting side and a receiving side respectively formed at two sides of said magazine shell, said transmitting side transmitting a detection signal receivable by said receiving side, a signal path being defined between said transmitting side and said receiving side, said sensor outputting said control signal to said control circuit when said receiving side receives no signal from said transmitting side.

3. The electric nailing gun as defined in claim 1, wherein said sensor is a contact type switch touchable by said magazine follower to output said control signal to said control circuit when said magazine follower is moved to a predetermined position in said nail path.

4. The electric nailing gun as defined in claim 1 further comprising a safety switch connected to said control circuit for controlling the power of said electric nailing gun, and a push rod axially movably mounted in said gun body for controlling said safety switch, said push rod having a first end protruding out of said bore of said gun body and a second end connected to said safety switch for turning on said safety switch when said bore of said gun body contacts against a workpiece to move said push rod backwards.

5. The electric nailing gun as defined in claim 1 further comprising a warning device electrically connected to said control circuit and controllable by said control circuit to output a warning signal when the counting of said counter reaches a predetermined value.

6. The electric nailing gun as defined in claim 1, wherein said control circuit resets said counter and stops said counter from counting when said control circuit receives no control signal from said sensor, whereby when said control circuit receives no control signal from said sensor after reducing the supply of electric current to said coil, said control circuit resets said counter and resumes full supply of electric current to said coil.

* * * * *